United States Patent [19]

Arakawa et al.

[11] Patent Number: 4,764,455

[45] Date of Patent: Aug. 16, 1988

[54] COLOR IMAGE-FORMING PROCESS

[75] Inventors: Jun Arakawa; Masahiro Okada; Takatoshi Ishikawa, all of Kanagawa, Japan

[73] Assignee: Fuji Photo Film Co., Ltd., Kanagawa, Japan

[21] Appl. No.: 893,746

[22] Filed: Aug. 6, 1986

[30] Foreign Application Priority Data

Aug. 6, 1985 [JP] Japan ..... 60-172968

[51] Int. Cl.[4] ..... G03C 7/00; G03C 5/38; G03C 1/46; G03C 1/02

[52] U.S. Cl. ..... 430/393; 430/400; 430/430; 430/460; 430/505; 430/517; 430/522; 430/567

[58] Field of Search ..... 430/393, 460, 517, 400, 430/567, 522, 505

[56] References Cited

U.S. PATENT DOCUMENTS

| | | | |
|---|---|---|---|
| 3,984,247 | 10/1976 | Nakamura et al. | 430/522 |
| 4,040,837 | 8/1977 | Sakamoto et al. | 430/460 |
| 4,045,229 | 8/1977 | Weber, II et al. | 430/512 |
| 4,366,233 | 12/1982 | Nakamura | 430/393 |
| 4,420,555 | 12/1983 | Krueger et al. | 430/507 |
| 4,458,010 | 7/1984 | Yamamuro et al. | 430/430 |

FOREIGN PATENT DOCUMENTS

| | | |
|---|---|---|
| 2040334 | 3/1977 | Japan . |
| 506385 | 7/1939 | United Kingdom . |
| 584609 | 2/1947 | United Kingdom . |
| 926569 | 5/1963 | United Kingdom . |

*Primary Examiner*—Mukund J. Shah
*Attorney, Agent, or Firm*—Sughrue, Mion, Zinn, Macpeak, and Seas

[57] ABSTRACT

A color image-forming process is described, for a silver halide color photographic material comprising a support having provided thereon at least one red-sensitive silver halide emulsion layer, at least one green-sensitive silver halide emulsion layer, and at least one blue-sensitive silver halide emulsion layer, which process comprises incorporating in the photographic material a yellow dye represented by formula (I) and processing the photographic material using a bleach-fixing solution containing a ferric complex of aminopolycarboxylic acid and a thiosulfate (I)

wherein $R_1$ and $R_2$ each represents a hydrogen atom, a halogen atom, an alkyl group, an alkoxy group, a hydroxy group, a carboxy group, a substituted amino group, a carbamoyl group, a sulfamoyl group, a nitro group or an alkoxycarbonyl group;

$R_3$ and $R_4$ each represents a hydrogen atom, an unsubstituted or substituted alkyl group, an unsubstituted or substituted alkenyl group, an unsubstituted or substituted aryl group, an acyl group or a sulfonyl group, or $R_3$ and $R_4$ may be taken together to form a 5- or 6-membered ring;

X represents a cyano group; and

Y represents an acyl group or a sulfonyl group.

8 Claims, No Drawings

COLOR IMAGE-FORMING PROCESS

FIELD OF THE INVENTION

This invention relates to a color image-forming process, and, more particularly, to a process for forming color image by rapidly removing silver from a silver halide color photographic light-sensitive material using a bleach-fixing solution.

BACKGROUND OF THE INVENTION

In general, the fundamental steps in processing color light-sensitive materials are a color-developing step and a desilvering step. In the color-developing step, exposed silver halide is reduced with a color-developing agent to produce silver, and, at the same time, the oxidized color-developing agent in turn reacts with a color former (coupler) to provide a dye image. In the subsequent desilvering step, silver having been produced in the color-developing step is oxidized by the action of an oxidant (called bleaching agent), then dissolved with a silver ion-chelating agent, usually called a fixing agent. After this desilvering step, only a dye image remains in the color light-sensitive material.

The above-described desilvering step is generally conducted in one of two manners: one is conducted using two baths of a bleaching agent-containing bleaching bath and a fixing agent-containing fixing bath; and the other is conducted using a mono-bath containing both a bleaching agent and a fixing agent.

In general, red prussiate, dichromates, ferric chloride, ferric complexes of aminopolycarboxylic acid, persulfates, etc., are known as bleaching agents.

However, red prussiate and dichromates involve environmental problems with respect to cyanide compounds and hexavalent chromium, and require special processing equipment. Ferric chloride involves the problem of production of ferric hydroxide in the subsequent water-washing step and the problem of forming stains, thus involving various difficulties in practical use. Persulfates have the defect that they possess such a weak bleaching power that they require an undesirably long bleaching time. As to this defect, it has been proposed to enhance the bleaching power by using together therewith a bleaching-accelerating agent. However, persulfates furthermore are generally regulated by laws with respect to the prevention of fire hazards; such laws provides for treatment of persulfates as dangerous substances and require various means for storage of persulfates, which are thus generally difficult to use.

Ferric complexes of aminopolycarboxylic acid (particularly ferric complexes of ethylenediaminetetraacetate) are at present most widely used as bleaching agents, since they cause less environmental problems and can be stored with no troubles. However, the bleaching power of the ferric complexes of aminopolycarboxylic acid is not fully satisfactory. When they are used as bleaching agents, the desired objects can be attained to some extent in the case of bleaching or bleach-fixing low-speed silver halide color light-sensitive materials primarily containing a silver chlorobromide emulsion. However, in the case of beleaching or bleach-fixing high speed color-sensitized color light-sensitive materials primarily containing a silver chlorobromoiodide or silver bromoiodide emulsion, particularly color reversal light-sensitive materials and color negative light-sensitive materials for photographic use using high silver content emulsions, there results somewhat insufficient removal of silver, or a long bleaching time is required.

For example, in bleaching color negative light-sensitive materials for photographing use using a bleaching solution containing ferric complex of aminopolycarboxylic acid, bleaching must be conducted for at least four minutes, and, in order to keep bleaching power, complicated control such as control of pH of the bleaching solution and controlled aeration is required. In fact, however, such control often still fails to prevent bleaching deficiencies.

On the other hand, as a means for accelerating the desilvering step, a bleach-fixing solution containing a ferric complex of aminopolycarboxylic acid and a thiosulfate as described in German Pat. No. 866,605 is known. However, when allowed to be copresent with the thiosulfate having a reducing power, the ferric aminopolycarboxylate originally having a weak oxidizing power (bleaching power) undergoes such a serious reduction of oxidizing power that it is extremely difficult to fully remove silver from a high-speed, high-silver content color light-sensitive material intended for photographic use; thus such proposed means is substantially unable to be put into practice. Of course, various attempts have been made to overcome the above-described defects of the bleach-fixing solution. For example, there is a technique of adding an iodide or bromide as described in British Pat. No. 926,569 and Japanese Patent Publication No. 11854/78, and technique of incorporating a ferric complex of aminopolycarboxylic acid in a high concentration with the aid of triethanolamine as described in Japanese Patent Application (OPI) No. 95834/73 (the term "OPI" as used herein means an "unexamined published application"). However, these techniques provide still insufficient effects, and cannot be practically employed with fully satisfactory effects.

As another technique for raising the bleaching power of the ferric complex of aminopolycarboxylic acid, it has been proposed to add various bleaching-accelerating agents to a bleaching bath, a bleach-fixing bath, or a pre-bath thereof.

As the bleaching-accelerating agents, there are illustrated, for example, various mercapto compounds as described in U.S. Pat. No. 3,893,858, British Pat. No. 138,842 and Japanese Patent Application (OPI) No. 141623/78, disulfide bond-containing compounds described in Japanese Patent Application (OPI) No. 95630/78, thiazolidine derivatives as described in Japanese Patent Publication No. 9854/78, isothiourea derivatives as described in Japanese Patent Application (OPI) No. 94927/78, thiourea derivatives as described in Japanese Patent Publication Nos. 8506/70 and 26586/74, etc.

Some of these accelerating agents show a bleaching-accelerating effect to some extent, but the effect is not necessarily sufficient. Thus, they fail to meet the requirement for shortening the processing time.

On the other hand, in silver halide photographic materials, it is well known to provide a layer which absorbs a light of specific wavelength for the purpose of forming a light-absorbing filter, preventing halation, or adjusting sensitivity of light-sensitive emulsions. As is described in T. H. James, *The Theory of the Photographic Process,* (Macmillan, 1977), pp. 336–337, it is particularly popular to provide a yellow filter layer at a position nearer to a support than a blue-sensitive layer and more distant from the support than other color-sensitive layers.

These colloidal silver particles contained in the yellow filter layer are known to often cause harmful contact fog in adjacent emulsion layers.

Various attempts have been made for preventing this contact fog. For example, Japanese patent Application (OPI) No. 83852/83 describes to add mercaptotetrazole, U.S. Pat. No. 3,206,310 describes to add derivatives of benzothiazole and benzoselenazole, German Patent Publication No. 1,168,251 describes to use triazaindolizine, and Japanese Patent Publication No. 47305/84 describes to use an alkali metal iodide or ammonium iodide. However, in order to obtain sufficient effects, these compounds must be added in large amounts due to their weak ability of preventing contact fog. It has been found that, in the case of using them in large amounts, desilvering properties of the light-sensitive materials are seriously in photographic processing steps, particularly in the bleach-fixing step.

In addition, it has been found that when the contact fog-preventing additives are used in large amounts in the yellow filter layer, light-sensitive materials undergo deterioration of photographic properties after storage, particularly serious reduction in sensitivity of adjacent layers when stored at high temperatures under high humidity.

As is described above, it has been quite difficult to obtain a light-sensitive material which contains a yellow filter of yellow colloidal silver, which shows good desilvering properties and undergoes no contact fog upon being processed in a bleach-fixing solution, and which does not undergo deterioration of photographic properties during storage.

In order to solve the problem of bleaching difficulty in processing a colloidal silver-containing light-sensitive material in a bleaching bath having a weak oxidizing power, it is known to add an aminothiol compound as disclosed in Japanese Patent Application (OPI) No. 83852/83 to the colloidal silver-containing layer or other layer. However, this technique has a photographically serious defect that light-sensitive materials based on this technique undergo fogging of emulsions when stored under the conditions of comparatively high temperature and high humidity. Further, when processed in a bleach-fixing solution containing a ferric complex of aminopolycarboxylic acid and a thiosulfate, light-sensitive materials prepared according to the above-described technique show insufficient desilvering.

Various attempts have been made to use organic dyes in the filter layer in place of colloidal silver. Examples include pyrazolone oxonol dyes as described in British Pat. No. 506,385, barbituric acid oxonol dyes as described in U.S. Pat. No. 3,247,127, azo dyes as described in U.S. Pat. No. 2,390,707, styryl dyes as described in U.S. Pat. No. 2,255,077, hemioxonol dyes as described in British Pat. No. 584,609, merocyanine dyes as described in U.S. Pat. No. 2,493,747, cyanine dyes as described in U.S. Pat. No. 2,843,486, etc.

Desilvering properties of high-speed color light-sensitive materials in bleach-fixing processing can be greatly improved by substituting these dyes for colloidal silver. However, conventional dyes have been quite difficult to put into practice since they do not necessarily meet certain requirements. That is, dyes to be used for such purpose (1) must have good absorption spectrum properties suited for the intended use, (2) must be easily decolored and dissolved away from silver halide photographic materials during photographic development processing and must not remain in the photographic materials after development processing so as to substantially prevent color stain, (3) must not exert detrimental influences on photographic emulsions such as fogging or desensitization, (4) must not diffuse from their own layers to other layers, and (5) must be stable and unchangeable with lapse of time in processing solutions or in silver halide photographic materials.

As is disclosed, for example, in Japanese Patent Application (OPI) No. 40334/77, it is a well known technique to treat silver halide color photographic materials containing dyes which prevent irradiation or halation, in a bleach-fixing solution. However, dyes used for these purposes easily diffuse into other layers. When these dyes diffuse from the layer to which they are added to other layers, they seriously reduce the sensitivity of the other emulsion layers and, in addition, seriously reduce the effect of the filter layer itself.

SUMMARY OF THE INVENTION

An object of the present invention is to provide a silver halide color photographic material showing good desilvering properties when rapidly processed in a bleach-fixing solution.

Another object of the present invention is to provide a silver halide color photographic material which undergoes extremely slight deterioration of photographic properties during storage.

A further object of the present invention is to provide a silver halide color photographic material having a yellow dye layer excellent in filter effect.

A still further object of the present invention is to provide a silver halide color photographic material having a yellow dye layer which contains a yellow dye selectively dyeing a specific layer and not diffusing into other layers.

Still, a further object of the present invention is to provide a silver halide photographic material having a yellow dye layer which contains a yellow dye capable of being decolored or dissolved away by photographic processing to scarcely remain in the processed photographic material.

These and other objects of the present invention will become apparent from the following description thereof.

As a result of investigations, the inventors have found that the above-described and other objects can be attained by processing a silver halide color photographic material containing a yellow dye represented by formula (I) in a bleach-fixing solution containing a ferric complex of aminopolycarboxylic acid and a thiosulfate

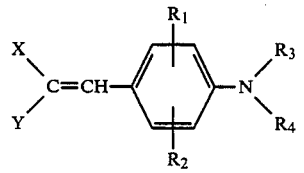

(I)

wherein $R_1$ and $R_2$ each represents a hydrogen atom, a halogen atom, an alkyl group, an alkoxy group, a hydroxy group, a carboxy group, a substituted amino group, a carbamoyl group, a sulfamoyl group, a nitro group, or an alkoxycarbonyl group, $R_3$ and $R_4$ each represents a hydrogen atom, an unsubstituted or substituted alkyl group, an unsubstituted or substituted alkenyl group, an unsubstituted or substituted aryl group, an acyl group or a sulfonyl group, or $R_3$ and $R_4$ may be taken together to form a 5- or 6-membered ring, X represents a cyano group, and Y represents an acyl group or a sulfonyl group.

DETAILED DESCRIPTION OF THE INVENTION

In formula (I), $R_1$ and $R_2$ (which may be the same or different) each represents a hydrogen atom, a halogen atom (for example, a fluorine atom, a chlorine atom, a bromine atom, etc.), an alkyl group (for example, a methyl group, an ethyl group, a propyl group, etc.), an alkoxy group (for example, a methoxy group, an ethoxy group, a propoxy group, etc.), a hydroxy group, a carboxy group, an amino group substituted by an acyl group derived from an aliphatic carbonyl acid or a sulfonic acid (for example, an acetylamino group, a methanesulfonylamino group, an ethanesulfonylamino group, etc.), an alkylamino group (e.g., a methylamino group, a propylamino group, a hexylamino group, etc.), a dialkylamino group (for example, a dimethylamino group, a diethylamino group, etc.), a carbamoyl group (for example, a methylcarbamoyl group, an ethylcarbamoyl group, etc.), a sulfamoyl group (for example, a methylsulfamoyl group, an ethylsulfamoyl group, etc.), a nitro group, an alkoxycarbonyl group (for example, a methoxycarbonyl group, or an ethoxycarbonyl group, etc.).

$R_3$ and $R_4$ (which may be the same or different) each represents a hydrogen atom, an alkyl group (for example, a methyl group, an ethyl group, a propyl group, an isopropyl group, a butyl group, a hexyl group, etc.), a substituted alkyl group (substituents being a halogen atom, a hydroxy group, a cyano group, an alkoxy group, an acyl group, an acyloxy group, an acylamino group, a carbamoyl group, an alkylamino group, a dialkylamino group, a carboxy group, an alkoxycarbonyl group, an aryloxycarbonyl group, a sulfonyl group, a sulfonylamino group, a sulfamoyl group, a ureido group, an aryl group, etc.; specific examples of substituted alkyl group include a chloroethyl group, a bromoethyl group, a chloropropyl group, a hydroxyethyl group, a hydroxypropyl group, a cyanomethyl group, a cyanoethyl group, a cyanopropyl group, a methoxyethyl group, an ethoxyethyl group, an isopropoxyethyl group, an acetylmethyl group, an acetylethyl group, a benzoylmethyl group, an acetyloxymethyl group, a propionyloxyethyl group, an isobutyryloxyethyl group, a benzoyloxyethyl group, an acetylaminoethyl group, a propionylaminoethyl group, a methylcarbamoylethyl group, a methylaminoethyl group, an ethylaminoethyl group, a dimethylaminoethyl group, a dimethylaminopropyl group, a carboxymethyl group, a carboxyethyl group, a carboxypropyl group, a carboxyhexyl group, a methoxycarbonylmethyl group, an ethoxycarbonylmethyl group, an isopropoxycarbonylmethyl group, a bis(isopropoxycarbonyl)methyl group, a bis(ethoxycarbonyl)methyl group, a 2,2,2-trifluoroethoxycarbonylmethyl group, a 2-methylsulfonylethoxycarbonylmethyl group, a 2-cyanoethoxycarbonylmethyl group, an ethoxycarbonylpropyl group, a phenoxycarbonylmethyl group, a methylsulfonylmethyl group, a methylsulfonylethyl group, a methanesulfonylaminoethyl group, a methanesulfonylaminopropyl group, a methylsulfamoylethyl group, a methylaminocarbonylaminoethyl group, a phenylmethyl group, etc.), an unsubstituted or substituted alkenyl group (for example, a 3-hexenyl group, etc.), an unsubstituted or substituted aryl group (for example, a phenyl group, a 3-chlorophenyl group, a 4-chlorophenyl group, a 4-cyanophenyl group, a 4-hydroxyphenyl group, a 4-methoxyphenyl group, etc.), an acyl group (for example, an acetyl group, a propionyl group, a benzoyl group, etc.), a sulfonyl group (for example, a methylsulfonyl group, an ethylsulfonyl group, a hexylsulfonyl group, a phenylsulfonyl group, a 4-chlorophenylsulfonyl group, a 4-cyanophenylsulfonyl group, etc.), or $R_3$ and $R_4$ may be bound to each other to form a 5- or 6-membered ring.

Y represents an acyl group, a sulfonyl group. Specific examples of Y include an acetyl group, a propionyl group, a benzoyl group, a 4-aminobenzoyl group, a 4-nitrobenzoyl group, a 4-methanesulfonylaminobenzoyl group, a 4-ethanesulfonylaminobenzoyl group, a 4-propanesulfonylaminobenzoyl group, a 4-trifluoromethanesulfonylaminobenzoyl group a 4-trifluoroacetylaminobenzoyl group, a 4-trichloroacetylaminobenzoyl group, a 3-hydroxy-4-methanesulfonylaminobenzoyl group, a 3-methanesulfonylaminobenzoyl group, a 3-propanesulfonylaminobenzoyl group, a 2-methanesulfonylaminobenzoyl group, a 4-methoxybenzoyl group, a 4-nitrobenzoyl group, a 3-nitrobenzoyl group, a 4-methylaminocarbonylaminobenzoyl group, a 4-ethylaminocarbonylaminobenzoyl group, a 4-ethoxycarbonylaminosulfonylaminobenzoyl group, a 4-methoxycarbonylaminosulfonylaminobenzoyl group, a 3-methylaminocarbonylaminobenzoyl group, a methylsulfonyl group, an ethylsulfonyl group, a decylsulfonyl group, a phenylsulfonyl group, etc.

Specific examples of compounds of formula (I) used in accordance with the present invention are illustrated below, which, however, do not limit the present invention in any way.

Illustrative compounds

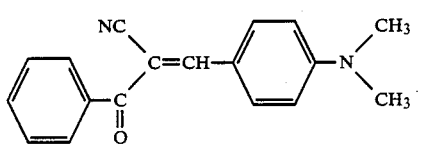

Y1

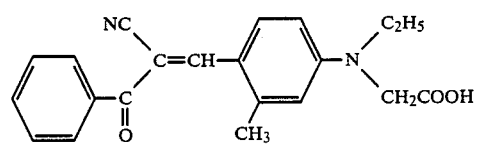

Y2

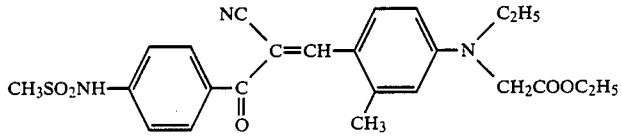

Y3

-continued
Y4
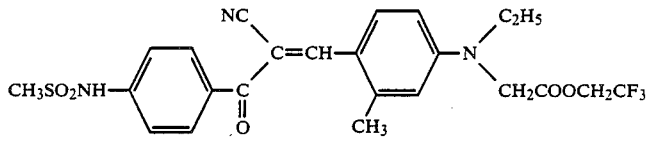
Y5
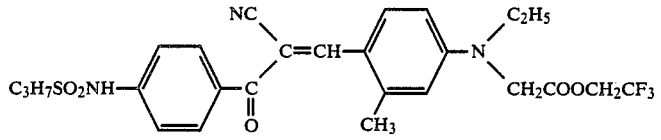
Y6
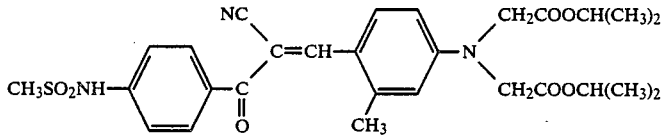
Y7
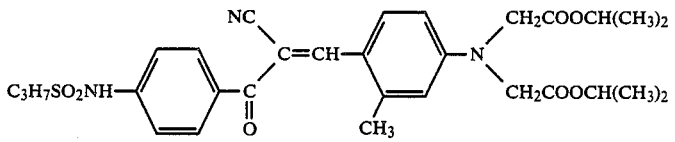
Y8
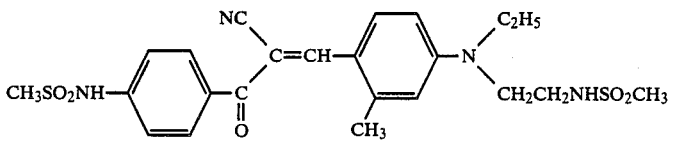
Y9
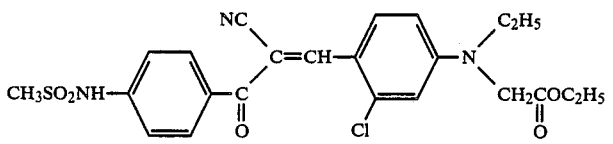
Y10
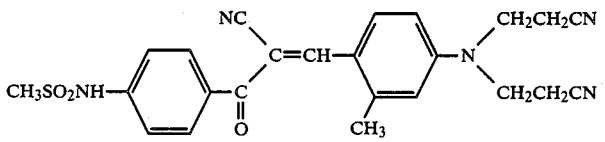
Y11
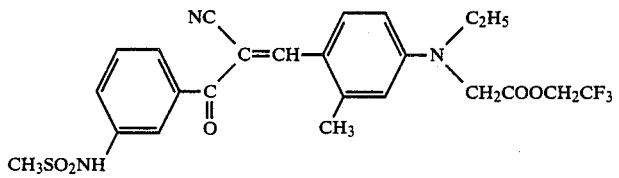
Y12
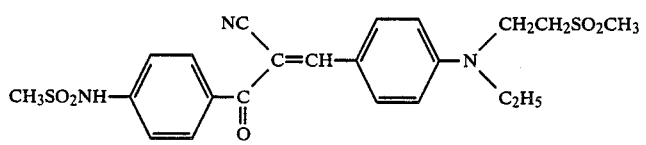
Y13
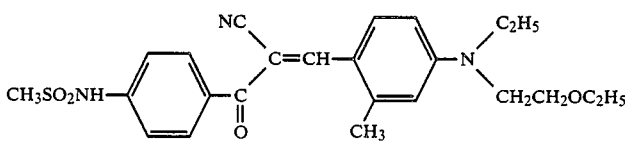

-continued
Y14
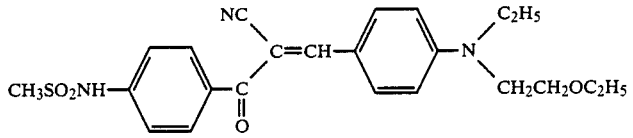
Y15
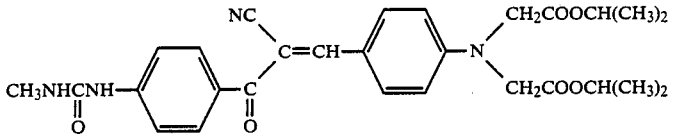
Y16
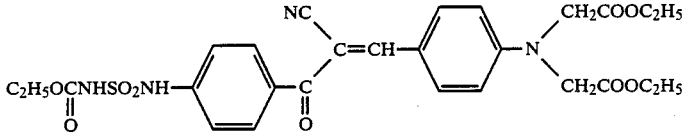
Y17
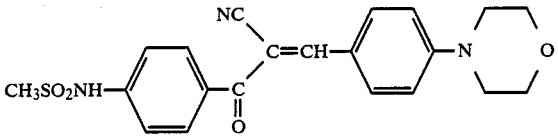
Y18
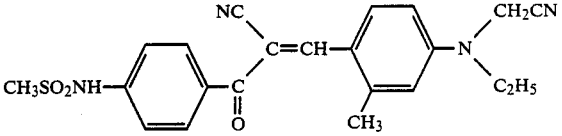
Y19
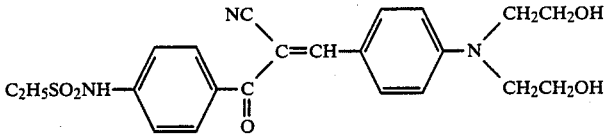
Y20
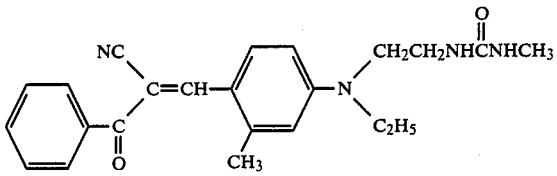
Y21
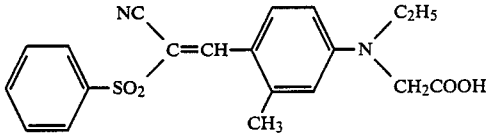
Y22
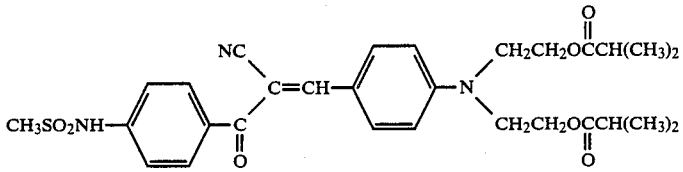
Y23
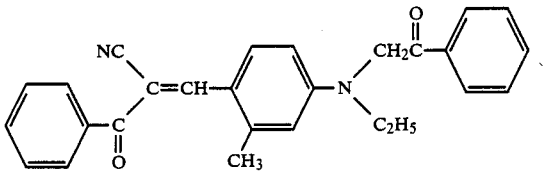
Y24
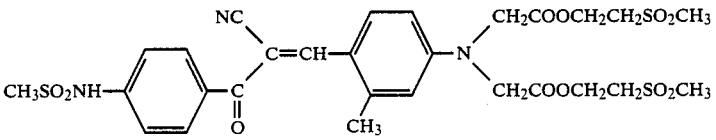

-continued
Y25
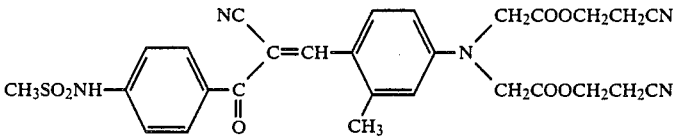
Y26
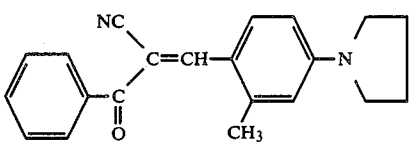
Y27
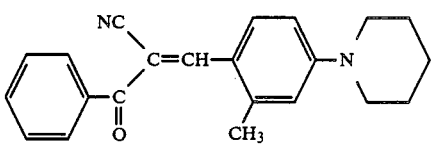
Y28
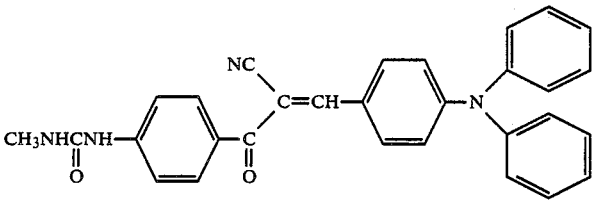
Y29
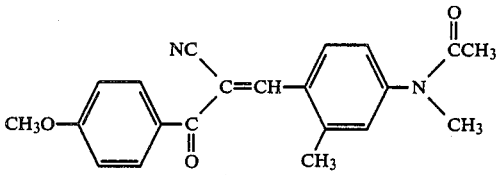
Y30
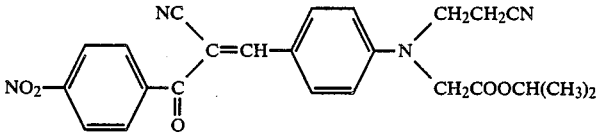
Y31
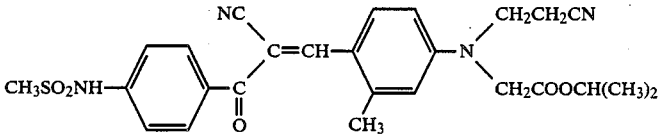
Y32
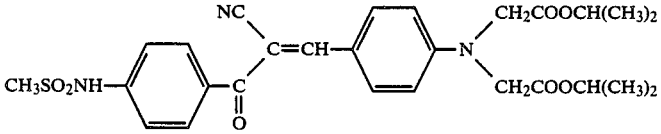
Y33
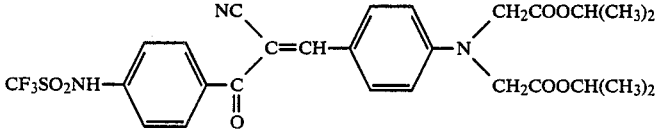
Y34
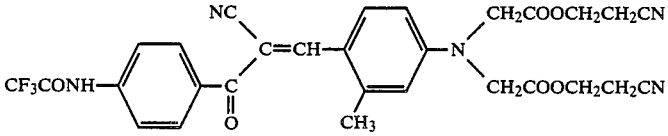
Y35
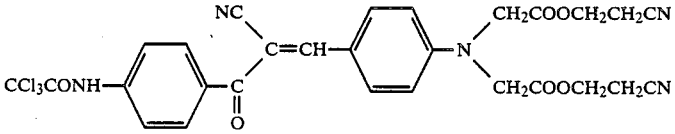

-continued

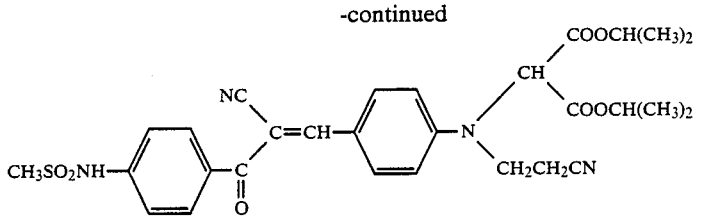

Y36

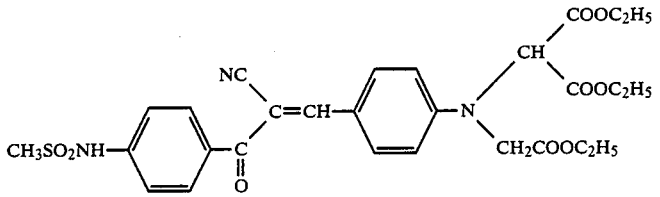

Y37

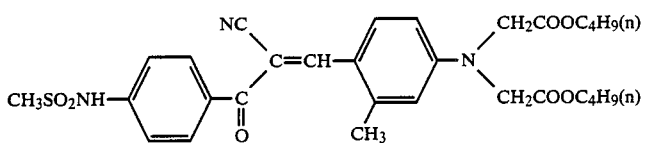

Y38

The dye compounds to be used in the present invention can be easily synthesized according to the process described in U.S. Pat. No. 4,420,555.

In the color photographic material of the present invention, dyes of formula (I) are used preferably in amounts of from 1 to 2,000 mg/m$^2$, and more preferably from 50 to 800 mg/m$^2$.

The dyes represented by formula (I) may be used in any effective amount, however, if the optical density of the dyes represented by formula (I) is extremely low, the effect of the yellow filter can not be shown, in other words, it is unavoidable that the green sensitive layer and the red sensitive layer is sensitized by blue light, and furthermore, in order to obtain very high optical density, much amount of the dyes are required, with the result that the film thickness becomes very thick, and the sharpness is deterioroted. Therefore, the dyes represented by formula (I) are preferably used in such amounts that the resulting optical density falls within a range of from 0.05 to 3.0.

In the color photographic material of the present invention, the yellow dye represented by formula (I) is preferably incorporated in the yellow filter layer. Furthermore, colloidal silver may be used as a yellow filter together with the yellow dye. The colloidal silver content in the color photographic material of the present invention is preferably 0.1 g/m$^2$ or less.

The dyes of the present invention can be dispersed in a hydrophilic colloidal layer, particularly preferably a light-insensitive hydrophilic colloidal layer provided at a position nearer to the support than a blue-sensitive layer and more distant from the support than a green-sensitive and a red-sensitive layer, by various known processes.

(1) A process of directly dissolving or dispersing the dye of the present invention in a hydrophilic colloidal layer, or a process of first dissolving or dispersing the dye in an aqueous solution or a solvent, then using it in an emulsion layer or a hydrophilic colloidal layer. It is also possible to dissolve the dye in a proper solvent such as methyl alcohol, ethyl alcohol, propyl alcohol, methyl cellosolve, halogenated alcohol described in Japanese Patent Application (OPI) No. 9715/73 and U.S. Pat. No. 3,756,830, acetone, methyl ethyl ketone, water, pyridine, etc. or a mixture solvent thereof, and add as a solution. In this case, various surfactants may be incorporated.

(2) A process of dissolving the compound in a substantially water-insoluble high-boiling solvent having a boiling point of about 160° C. or higher, and adding the resulting solution to a hydrophilic colloidal solution, followed by dispersing the mixture. As the high-boiling solvent, there may be used those which are described in U.S. Pat. No. 2,322,027, such as alkyl phthalates (e.g., dibutyl phthalate, dioctyl phthalate, etc.), phosphates (e.g., diphenyl phosphate, triphenyl phosphate, tricresyl phosphate, dioctylbutyl phosphate, etc.), citric esters (e.g., tributyl acetylcitrate, etc.), benzoic acid esters (e.g., octyl benzoate, etc.), alkylamides (e.g., diethyllaurylamide, etc.), fatty acid esters (e.g., dibutoxyethyl succinate, diethyl azelate, etc.), trimesic acid esters (e.g., tributyl trimesate, etc.), and the like. It is also possible to use organic solvents having a boiling point of from about 30° C. to about 150° C., such as lower alkyl acetates (e.g., ethyl acetate, butyl acetate, etc.), ethyl propionate, sec-butyl alcohol, methyl isobutyl ketone, $\beta$-ethoxyethyl acetate, methylcellosolve acetate, and water-miscible solvents (e.g., methanol, ethanol, etc.).

The ratio of the dye to the high-boiling solvent is preferably from 40/1 to 1/10 (by weight).

(3) A process of incorporating the dye of the present invention and other additives as a polymer latex composition for filling a hydrophilic colloidal layer.

As the above-described polymer latex, there are illustrated, for example, polyurethane polymers and polymers prepared by polymerizing vinyl monomers. Suitable vinyl monomers including acrylates (e.g., methyl acrylate, ethyl acrylate, butyl acrylate, hexyl acrylate, octyl acrylate, dodecyl acrylate, glycidyl acrylate, etc.), $\alpha$-substituted acrylates (e.g., methyl methacrylate, butyl methacrylate, octyl methacrylate, glycidyl methacrylate, etc.), acrylamides (e.g., butylacrylamide, hexylacrylamide, etc.), $\alpha$-substituted acrylamides (e.g., butylmethacrylamide, dibutylmethacrylamide, etc.), vinyl esters (e.g., vinyl acetate, vinyl butyrate, etc.), halogenated vinyl compounds (e.g., vinyl chloride, etc.), vinylidene halides (e.g., vinylidene chloride, etc.), vinyl ethers (e.g., vinyl methyl ether, vinyl octyl ether, etc.), styrene, α- or β-substituted styrene (e.g., α-methylstyrene, etc.), nucleus-substituted styrenes (e.g., hydroxystyrene, chlorostyrene, methylstyrene, etc.), ethylene, propylene, butylene, butadiene, acrylonitrile, etc., which may be used alone or in combination, and may be optionally used together with a minor component of other vinyl monomers such as itaconic acid, acrylic acid, methacrylic acid, hydroxyalkyl acrylate, hydroxyalkyl methacrylate, sulfoalkyl acrylate, sulfoalkyl methacrylate, styrenesulfonic acid, etc.

These filling polymer latexes may be prepared according to the processes described in Japanese Patent Publication No. 39853/76, Japanese Patent Application (OPI) Nos. 59943/76, 137131/78, 32552/79, 107941/79 133465/80, 19043/81, 19047/81, 126830/81, and 149038/83.

The ratio of the dye to the polymer latex is preferably from 40/1 to 1/10 (by weight).

(4) A process of dissolving the compound using a surfactant. Useful surfactants are oligomers or polymers. Such polymers are described in detail in Japanese Patent Application (OPI) No. 158437/85, pp. 19–27.

(5) A process of using a hydrophilic polymer in place of, or together with, the high-boiling point solvent used in (2) described hereinbefore. This process is described, for example, U.S. Pat. No. 3,619,195 and West German Pat. No. 1,957,467.

(6) A microencapsulating process using a polymer having carboxy groups, sulfonic acid groups, etc. in side chains as described in Japanese Patent Application (OPI) No. 113434/84.

To the above-obtained hydrophilic colloidal dispersion may be added, for example, a hydrosol of an oleophilic polymer described in Japanese Patent Publication No. 39835/76.

As the hydrophilic colloid, gelatin is typical. However, any of those which are conventionally known as usable in photographic material may be used.

After color development processing, silver halide color photographic materials to be used in the present invention are subjected to bleach-fixing treatment. As ferric complexes of aminopolycarboxylic acid to be used in the bleach-fixing solution, ferric complexes of the following aminopolycarboxylic acids are preferable, but they are not limitative at all.

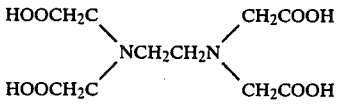
K-1

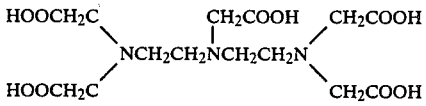
K-2

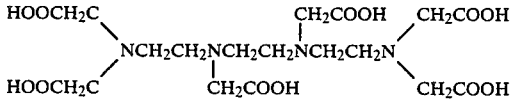
K-3

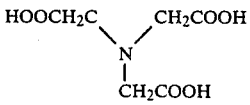
K-4

-continued

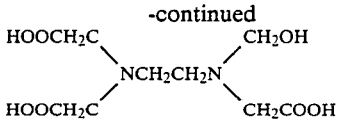
K-5

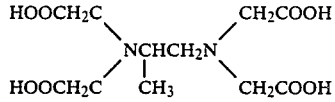
K-6

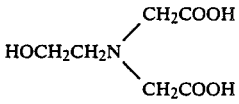
K-7

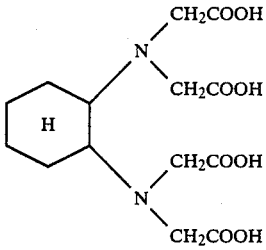
K-8

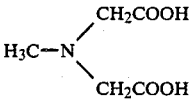
K-9

K-10

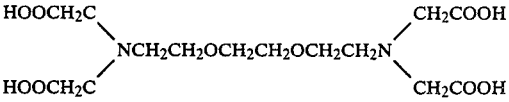

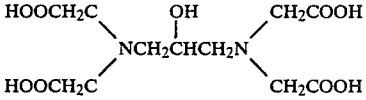
K-11

These iron complex salts are preferably sodium salt, potassium salt, ammonium salt, and lithium salt. These iron complex salts are used preferably in amounts of from 50 to 300 g/liter of the bleach-fixing solution.

As the thiosulfates to be used, sodium thiosulfate, potassium thiosulfate, and ammonium thiosulfate are typical, which, however, are not limitative at all.

Silver halide emulsions usable in the present invention may be any of silver bromide, silver iodobromide, silver iodochlorobromide, silver chlorobromide, and silver chloride. Preferable silver halide is silver iodobromide or silver iodochlorobromide (preferably containing from 1 to 20 mol% of silver iodide).

Silver halide grains in the photographic emulsion layer may be in a regular crystal form such as cubic or octahedral form, in an irregular crystal form such as spherical or tabular form, or in a mixed form thereof, or may comprise a mixture of grains in different crystal forms.

In addition, tabular grains having a diameter-to-thickness ratio of 3 or more, preferably from 5 to 20, may be used. Such tabular grains may account for 50% or more of the whole projected area. Detailed descriptions on such emulsions are given in U.S. Pat. Nos. 4,434,226 and 4,439,520, European Pat. No. 84,637 $A_2$, Gutoff, *Photographic Science and Engineering*, Vol. 14, pp. 248–257 (1970), etc.

Where a silver halide emulsion layer adjacent to a yellow filter layer consisting essentially of colloidal silver comprises the aforesaid tabular grains, the problem of insufficient desilvering tends to arise. This tendency is particularly serious when tabular grains are color-sensitized. However, such problem can be solved by changing colloidal silver in the yellow filter layer to the yellow dye of the present invention represented by formula (I) or by using the yellow dye of formula (I) together with colloidal silver, though the reason therefor is not clear. Therefore, particularly excellent effects of the present invention can be obtained when the emulsion layer adjacent to the yellow filter layer is color-sensitized and contains tabular grains having a diameter-to-thickness ratio of 5 or more.

Silver halide grains to be used may have an inner portion and a surface layer different from each other in phase composition, or may comprise a uniform phase. In addition, silver halide grains of the type forming latent image mainly on the surface thereof (e.g., negative emulsions) and grains of the type froming latent image mainly within them (e.g., internal latent image emulsions and previously fogged direct reversal emulsions) may be used.

Silver halide emulsions to be used in the present invention may contain platy silver halide grains 50% or more (based on the whole projected area) of which are grains having a thickness of 0.5 μm or less, preferably 0.3 μm or less, a diameter of at least 0.6 μm, and an average aspect ratio of 5 or more. In addition, a monodisperse emulsion wherein 95% or more in number of grains have diameters falling within ±40% of the average grain size may also be used.

The photographic emulsion to be used in the present invention may be prepared according to the processes described in P. Glafkides, *Chimie et Physique Photographeque,* (Paul Montel, 1967), G. F. Duffin, *Photographic Emulsion Chemistry,* (Focal Press, 1966), V. L. Zelikman et al, *Making and Coating Photographic Emulsion,* (Focal Press, 1964), etc.

Upon formation of the silver halide grains, silver halide solvents may be allowed to be copresent for controlling growth of the grains. Examples of the silver halide solvents include ammonia, potassium rhodanide, ammonium rhodanide, thioether compounds (e.g., those described in U.S. Pat. Nos. 3,271,157, 3,574,628, 3,704,130, 4,297,439, 4,276,374, etc.), thione compounds (e.g., those described in Japanese Patent Application (OPI) Nos. 144319/78, 82408/78, 77737/80, etc.), amine compounds (e.g., those described in Japanese Patent Application (OPI) No. 100717/79), etc.

During formation or physical ripening of silver halide grains, cadmium salts, zinc salts, thallium salts, irridium salts or the complex salts thereof, rhodium salts or the complex salts thereof, iron salts or the complex salts thereof, etc., may be allowed to coexist therewith.

Usually, silver halide emulsions are chemically sensitized. Chemical sensitization can be conducted according to the processes described, for example, in H. Frieser, *Die Grundlagen der Photographischen Prozesse mit Silverhalogeniden,* (Akademische Verlagesgesellschafte, 1968), pp. 675–734.

That is, sulfur sensitization using active gelatin or sulfur-containing compounds capable of reacting with silver ion (e.g., thiosulfates, thioureas, mercapto compounds, rhodanines, etc.), reduction sensitization using a reductive substance (e.g., stannous chloride, amines, hydrazine derivatives, formamidinesulfinic acid, silane compounds, etc.), and noble metal sensitization using compounds of noble metals (e.g., gold complex salts, complex salts of the group VIII metals such as Pt, Ir, Pd, etc.), and the like can be employed alone or in combination.

Various compounds may be incorporated in the photographic emulsion to be used in the present invention for the purpose of preventing formation of fog or stabilizing photographic properties in the steps of producing, or during storage or processing of, light-sensitive materials. That is, many compounds known as antifoggants or stabilizers such as azoles (e.g., benzothiazolium salts, nitroindazoles, triazoles, benzotriazoles, benzimidazoles (particularly, nitro- or halogen-substituted derivatives), etc.); hetero ring-containing mercapto compounds (e.g., mercaptothiazoles, mercaptobenzothiazoles, mercaptobenzimidazoles, mercaptothiadiazoles, mercaptotetrazoles (particularly, 1-phenyl-5-mercaptotetrazole), and mercaptopyrimidines; hetero ring-containing mercapto compounds described above having a water-soluble group such as a carboxyl group or a sulfo group; thioketo compounds (e.g., oxazolinthione); azaindenes (e.g., tetraazaindenes (particularly 4-hydroxy-substituted (1,3,3a,7)tetraazaindenes); benzenethiosulfonic acids; benzenesulfinic acids; and like compounds can be added.

The silver halide photographic emulsion of the present invention may contain color couplers such as a cyan coupler; a magenta coupler, a yellow coupler, etc. and a compound for dispersing the couplers.

That is, the photographic emulsion may contain those compounds which can form color by oxidative coupling with an aromatic primary amine developing agent (for example, a phenylenediamine derivative or an aminophenol derivative) in color development processing. For example, magenta couplers include 5-pyrazolone couplers, pyrazolobenzimidazole couplers, pyrazoloazole couplers, cyanoacetylcoumarone couplers, open-chain acylacetonitrile couplers, etc., yellow couplers include acylacetamide couplers (e.g., benzoylacetanilides, pivaloylacetanilides, etc.), and cyan couplers include naphtholic couplers and phenolic couplers. Of these couplers, non diffusible couplers having a hydrophobic group called ballast group are desirable. The couplers may be of either 4-equivalent type or 2-equivalent type based on silver ion. Colored couplers having color-correcting effect or couplers capable of releasing a development inhibitor upon development (called DIR couplers) may also be used. In addition to the DIR couplers, non-color forming DIR coupling compounds capable of forming a colorless coupling reaction product and releasing a development inhibitor may also be incorporated.

The photographic emulsion of the present invention may contain a polyalkylene oxide or its ether, ester or amide derivative, a thioether compound, a thiomorpholine, a quaternary ammonium salt compound, an urethane derivative, a urea derivative, an imidazole derivative, a 3-pyrazolidone, etc. for the purpose of increasing sensitivity or contrast or for accelerating development.

The silver halide photographic emulsion of the present invention may contain a known water-soluble dye (e.g., an oxonol dye, a hemioxonol dye, and merocyanine dye) other than the dyes disclosed in the present invention, as a filter dye or for various purposes such as prevention of irradiation. In addition, known cyanine dyes, merocyanine dyes, or hemicyanine dyes other than the dyes disclosed in the present invention may also be used together as spectral sensitizing agents.

The photographic emulsion of the present invention may contain various surfactants for various purposes such as improvement of coating properties, antistatic properties, sliding properties, emulsification dispersion, anti-adhesion properties, and photographic properties (for example, development acceleration, increasing high contrast, sensitization, etc.).

Fading preventing agents, hardeners, color anti-foggant, UV ray absorbents, protective colloids such as gelatin, and various additives that can be optionally added to the light-sensitive material of the present invention are specifically described, for example, in *Research Disclosure,* Vol. 176 (1978, XII), RD-17643, etc.

Finished emulsions are coated on suitable supports such as baryta paper, resin-coated paper, synthetic paper, triacetate film, polyethylene terephthalate film, other plastic bases, or a glass plate.

Silver halide photographic materials of the present invention include color positive film, color papers, color negative film, color reversal film (including or not including couplers), etc. The present invention is particularly effective for color light-sensitive materials for photographic use.

In the light-sensitive material of the present invention, the silver (of the silver holide) is preferably coated in an amount of from 4 to 20 g/m$^2$, and more preferably from 7 to 15 g/m$^2$.

Exposure for obtaining photographic image may be conducted in a usual manner. That is, any of various known light sources may be employed such as natural light (sun light), tungsten lamp, fluorescent lamp, mercury lamp, xenon arc lamp, carbon arc lamp, xenon flash lamp, cathode ray tube flying spots, etc. As exposure time, not only an exposure time of from 1/1000 second to one second employed for ordinary cameras, but also an exposure time shorter than 1/1000 second, for example, 1/10$^4$ to 1/10$^6$ second using a xenon flash lamp or a cathode ray tube, and an exposure time longer than one second may be used as well. If desired, spectral composition of the light to be used for exposure may be adjusted by a color filter. Laser light may also be used for exposure. In addition, exposure may be conducted by using light emitted from a fluorescent substance excited by electron beam, X-rays, $\gamma$-rays, $\alpha$-rays, etc.

In photographic processing of the light-sensitive material of the present invention, known processes may be used, and known processing solutions may be employed. Processing temperature is usually selected between 18° and 50° C. However, temperatures lower than 18° C. or higher than 50° C. may be employed. The light-sensitive material of the present invention may be subjected to color photographic processing comprising development processing for forming dye image, depending upon the end use.

A color developing solution generally comprises an alkaline aqueous solution containing color developing agent. As the color developing agent, known primary amine developing agents such as phenylenediamines (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfoamidoethylaniline, 4-amino-3-methyl-N-ethyl-N-$\beta$-methoxyethylaniline, etc.) may be used.

In addition, those described in L. F. A. Mason, *Photographic Processing Chemistry,* (Focal Press, 1966), pp. 226–229, U.S. Pat. Nos. 2,193,015 and 2,592,364, Japanese Patent Application (OPI) No. 64933/73, etc. may also be used.

The developing solution may further contain pH buffers such as sulfites, carbonates, and phosphates of alkali metals, development inhibitors such as bromides, iodides, and organic anti-foggants, anti-fogging agents, etc. If desired, the developing solution may further contain hard water softeners, preservatives such as hydroxylamine, organic solvents such as benzyl alcohol and diethylene glycol, development accelerators such as polyethylene glycol, quaternary ammonium salts, amines, etc., dye-forming couplers, competitive couplers, fogging agents such as sodium borohydride, auxiliary developing agents such as 1-phenyl-3-pyrazolidone, tackifiers, polycarboxylic acid type chelating agents described in U.S. Pat. No. 4,083,723, and antioxidants described in West German Patent Application (OLS) No. 2,622,950.

Photographic processings to be employed in the present invention involve a fixing step, etc., as well as the aforesaid color developing and bleaching steps. Steps of washing with water, stabilization, etc., are generally conducted after the fixing or bleach-fixing step. However, a simple processing of conducting only the water-washing step or, to the contrary, only the stabilizing step with omission of the water-washing step (Japanese Patent Application (OPI) No. 8543/82) may also be employed.

The present invention is now illustrated in greater detail by reference to the following examples, which, however, are not to be construed as limiting the present invention in any way. Unless otherwise indicated, all percents, parts and ratios are by weight.

EXAMPLE 1

Multi-layer color photographic material 101 comprising a cellulose triacetate film support having provided thereon layers of the following formulations was prepared.

1st layer: Antihalation layer

A gelatin layer containing $1.6\times10^{-3}$ mol/m$^2$ of black colloidal silver.

2nd layer: Interlayer

A gelatin layer

3rd layer: First red-sensitive emulsion layer

| | |
|---|---|
| Silver iodobromide emulsion (AgI: 6 mol %; average grain size: 0.6 $\mu$m) | coated in a silver amount of 0.023 mol/m$^2$ |
| Sensitizing dye (I) | $6\times10^{-4}$ mol/mol of Ag |
| Sensitizing dye (II) | $1.5\times10^{-4}$ mol/mol of Ag |
| Coupler A | 0.05 mol/mol of Ag |
| Coupler B | 0.003 mol/mol of Ag |
| Coupler C | 0.002 mol/mol of Ag |
| Di-n-butyl phthalate | 1.0 g per g of coupler |

4th layer: Second red-sensitive emulsion layer

| | |
|---|---|
| Silver iodobromide emulsion (AgI: 8 mol %; average grain size: 1.0 $\mu$m) | coated in a silver amount of 0.011 mol/m$^2$ |
| Sensitizing dye (I) | $6\times10^{-4}$ mol/mol of Ag |
| Sensitizing dye (II) | $1.5\times10^{-4}$ mol/mol of Ag |
| Coupler D | 0.02 mol/mol of Ag |
| Coupler B | 0.002 mol/mol of Ag |
| Di-n-butyl phthalate | 1.0 g per g of coupler |

5th layer: Interlayer

A gelatin layer containing:

| | |
|---|---|
| 2,5-Di-t-octylhydroquinone | $2.2 \times 10^{-4}$ mol/m$^2$ |
| Tricresyl phosphate | |

6th layer: First green-sensitive emulsion layer

| | |
|---|---|
| Tabular silver iodobromide emulsion (AgI: 6 mol %; average grain size: 0.9 μm; thickness: 0.15 μm) | coated in a silver amount of 0.011 mol/m$^2$ |
| Sensitizing dye (III) | $9 \times 10^{-4}$ mol/mol of Ag |
| Sensitizing dye (IV) | $3 \times 10^{-4}$ mol/mol of Ag |
| Coupler E | 0.09 mol/mol of Ag |
| Coupler F | 0.03 mol/mol of Ag |
| Coupler G | 0.01 mol/mol of Ag |
| Tricresyl phosphate | 1.5 g per g of coupler |

7th layer: Second green-sensitive emulsion layer

| | |
|---|---|
| Silver iodobromide emulsion (AgI: 8 mol %: average grain size: 1.0 μm) | coated in a silver amount of 0.009 mol/m$^2$ |
| Sensitizing dye (III) | $3 \times 10^{-4}$ mol/mol of Ag |
| Sensitizing dye (IV) | $1 \times 10^{-4}$ mol/mol of Ag |
| Coupler H | 0.02 mol/mol of Ag |
| Coupler F | 0.006 mol/mol of Ag |
| Tricresyl phosphate | 1.5 g per g of coupler |

8th layer: Yellow filter layer

| | |
|---|---|
| Yellow colloidal silver | coated in a silver amount of $3.2 \times 10^{-3}$ mol/m$^2$ |
| 2,5-Di-t-octylhydroquinone | $1.8 \times 10^{-4}$ mol/m$^2$ |
| Tricresyl phosphate | 2.0 g per g of 2,5-di-t-octylhydroquinone |
| Contact fog-preventing agent S-1 | $2.3 \times 10^{-2}$ mol per mol of Ag |

9th layer: First blue-sensitive emulsion layer

| | |
|---|---|
| Silver iodobromide emulsion (AgI: 6 mol %; average grain size: 0.7 μm) | coated in a silver amount of 0.014 mol/m$^2$ |
| Coupler I | 0.25 mol/mol of Ag |
| Coupler J | 0.002 mol/mol of Ag |
| Tricresyl phosphate | 0.5 g per g of coupler |

10th layer: Second blue-sensitive emulsion layer

| | |
|---|---|
| Silver iodobromide emulsion (AgI: 8 mol %; average grain size: 1.2 μm) | coated in a silver amount of 0.010 mol/m$^2$ |
| Coupler J | 0.06 mol/mol of Ag |
| Tricresyl phosphate | 0.5 g per g of coupler |

11th layer: First protective layer

A gelatin layer containing:

Silver iodobromide fine-grain emulsion (AgI: 1 mol%; average grain size: 0.07 μm) coated in a silver amount of 0.5 g/m$^2$ An emulsion dispersion of UV ray absorbent UV-1 and tricresyl phosphate 12th layer: Second protective layer A gelatin layer containing polymethyl methacrylate particles (diameter: about 1.5 μm) was coated.

The couplers for the above-described layers were used as emulsions prepared by dissolving in a solution of a predetermined high-boiling solvent and ethyl acetate under heating, mixing the resulting solution with a 10% gelatin aqueous solution containing sodium p-dodecylbenzenesulfonate as an emulsifier, and emulsifying the mixture in a colloid mill.

To each of the above-described layers were added gelatin hardener H-1 and a surfactant in addition to the above-described ingredients.

Compounds used for preparing the sample were as follows.

Sensitizing dye (I):

Anhydro-5,5'-dichloro-3,3'-di(γ-sulfopropyl)-9-ethylthiacarbocyanine hydroxide pyridinium salt Sensitizing dye (II):

Anhydro-9-ethyl-3,3'-di-(γ-sulfopropyl)-4,5,4',5'-dibenzothiacarbocyanine hydroxide triethylamine salt Sensitizing dye (III):

Anhydro-9-ethyl-5,5'-dichloro-3,3'-di-(γ-sulfopropyl-)oxacarbocyanine sodium salt Sensitizing dye (IV):

Anhydro-5,6,5',6'-tetrachloro-1,1'-diethyl-3,3'-di-{β[β-(γ-sulfopropyl)-ethoxy]ethyl}imidazolocarbocyanine hydroxide sodium salt Coupler A

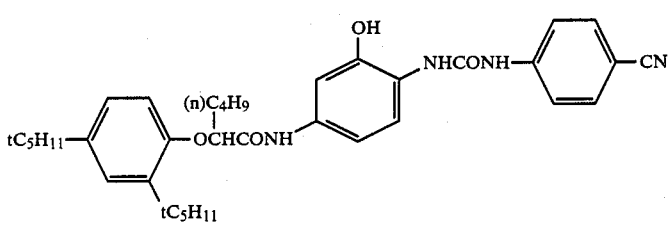

Coupler B

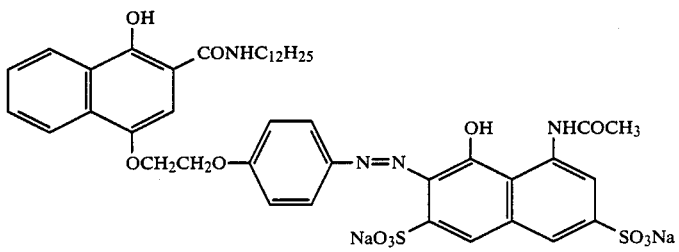

-continued
Coupler C
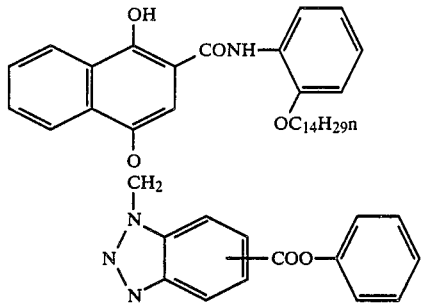
Coupler D
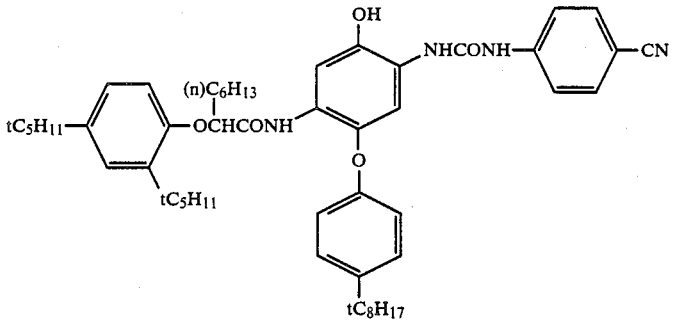
Coupler E
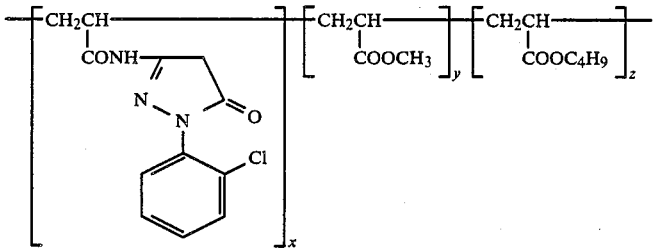
x/y/z = 50/25/25 (wt)
Coupler F
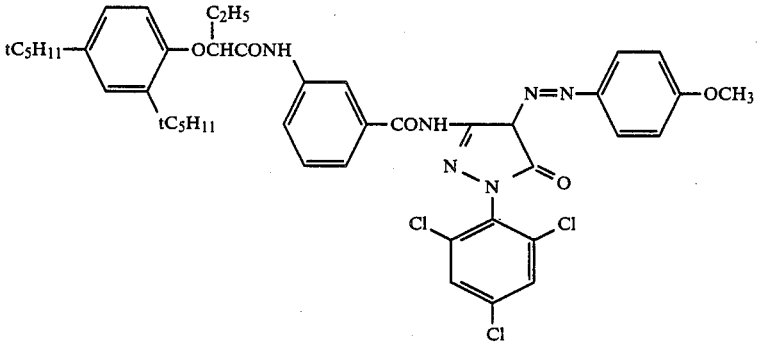
Coupler G
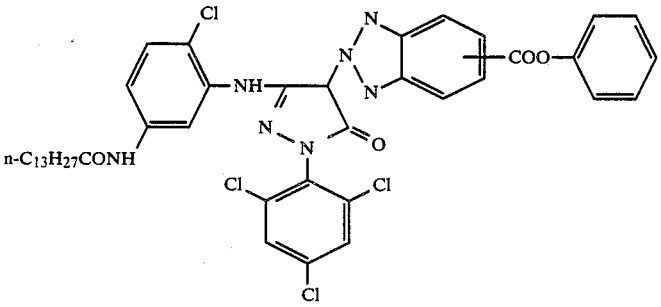

-continued

Coupler H

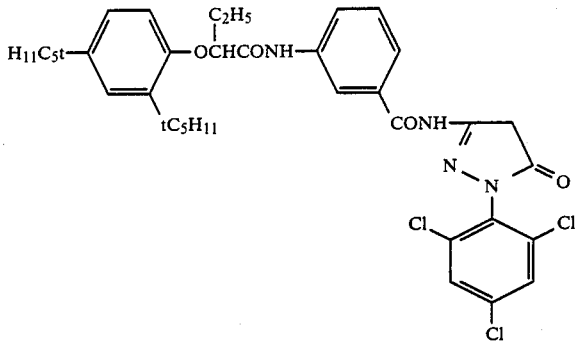

Coupler I

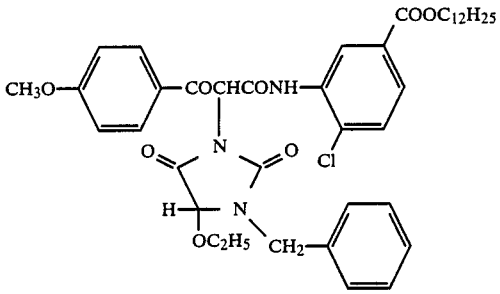

Coupler J

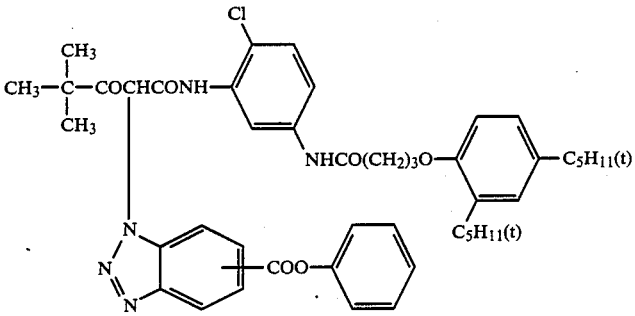

UV-1

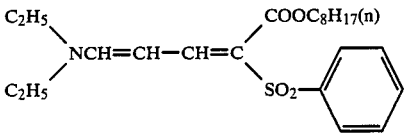

H-1 $CH_2{=}CHSO_2CH_2CONHCH_2CH_2NHCOCH_2SO_2CH{=}CH_2$

S-1

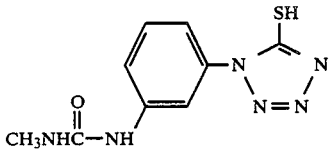

Preparation of Sample 102

Sample 102 was prepared in absolutely the same manner as Sample 101, except for using the following water-soluble yellow dye W-1 in an amount of $1.0\times10^{-3}$ mol/m$^2$ in the 8th layer in place of the yellow colloidal silver of Sample 101 and not using contact fog-preventing agent S-1.

Dye W-1:

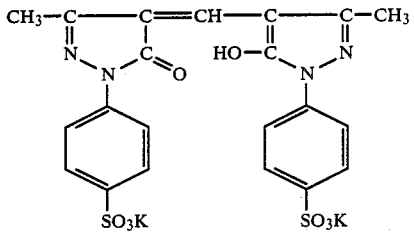

Preparation of Sample 103

Sample 103 was prepared in absolutely the same manner as Sample 101, except for using dye Y-6 in an amount of $1.1\times10^{-3}$ mol/m$^2$ in the 8th layer in place of the yellow colloidal silver of Sample 101 and not using contact fog-preventing agent S-1. Y-6 was used by dissolving in ethyl acetate under heating, dispersing the resulting solution in a gelatin aqueous solution using a colloid mill, then adding thereto an aqueous latex of methyl acrylate/acetoacetoxyethyl methacrylate (90/10 in copolymerization ratio) copolymer according to the method described in Japanese Patent Publication No. 39853/76.

Preparation of Sample 104

Sample 104 was prepared in the same manner as Sample 101, except for using dye Y-22 in an amount of $1.1\times10^{-3}$ mol/m$^2$ in the 8th layer in place of the yellow colloidal silver of Sample 101 and not using contact fog-prevenging agent S-1. Y-22 was added as a dispersion prepared by dissolving in a mixed solvent of ethyl acetate and tricresyl phosphate, dispersing the resulting solution in a gelatin aqueous solution using a colloid mill, and removing ethyl acetate using a rotary evaporator, to obtain a dispersion.

Preparation of Sample 105

Sample 105 was prepared in the same manner as Sample 101, except for changing the amount of the yellow colloidal silver in the 8th layer of Sample 101 to $1.6\times10^{-3}$ mol/m$^2$ and adding dye Y-38 in an amount of $0.5\times10^{-2}$ mol/m$^2$ in the 8th layer. Y-38 was added as a dispersion prepared by dissolving in a mixed solvent of ethyl acetate and tricresyl phosphate, dispersing the resulting solution in a gelatin aqueous solution using a colloid mill, and removing ethyl acetate using a rotary evaporator, to obtain a dispersion.

Each of Samples 101 to 105 (two samples for each) was exposed with a wedge tablet using white light, and subjected to processing (A) or (B) described hereinafter to evaluate photographic properties.

In addition, each of Samples 101 to 105 was stored for 3 days in an atmosphere of 50° C. and 80% RH (relative humidity), and exposed with a wedge tablet using white light and processed in the same manner as described above to determine the degree of reduction in green layer sensitivity, ΔSG, in comparison with the same sample not having been stored under the conditions of high temperature and high humidity of 50° C. and 80% RH.

The amount of residual silver in maximum density area was measured according to the fluorescent X-ray method to evaluate desilvering properties.

Table 1 shows the results of blue layer sensitivity, degree of reduction in green layer sensitivity between before and after storage under the conditions of high temperature and high humidity, and the residual amount of silver after photographic processing.

Processing (A): Ordinary processing

Development processing step (38° C.)

| | |
|---|---|
| 1. Color development | 3'15" |
| 2. Bleaching | 6'30" |
| 3. Washing with water | 3'15" |
| 4. Fixing | 6'30" |
| 5. Washing with water | 3'15" |

-continued

| | |
|---|---|
| 6. Stabilizing | 3'15" |

Composition of processing solutions:

Color developer

| | |
|---|---|
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—Ethyl-N—β-hydroxyethyl-amino)-2-methylaniline sulfate | 4.5 g |
| Water to make | 1 liter |

Bleaching solution

| | |
|---|---|
| Ammonium bromide | 160.0 g |
| Aqueous ammonia (28%) | 25.0 ml |
| Fe (III) ethylenediamine-tetraacetic acid sodium salt | 130.0 g |
| Glacial acetic acid | 14.0 ml |
| Water to make | 1 liter |

Fixing solution

| | |
|---|---|
| Sodium tetrapolyphosphate | 2.0 g |
| Sodium sulfite | 4.0 g |
| Aqueous solution of ammonium thiosulfate (70%) | 175.0 ml |
| Sodium bisulfite | 4.6 g |
| Water to make | 1 liter |

Stabilizing solution

| | |
|---|---|
| Formalin | 8.0 ml |
| Water to make | 1 liter |

Processing (B): Bleach-fixing processing

Development processing step (38° C.)

| | |
|---|---|
| 1. Color development | 3'15" |
| 2. Bleach-fixing | 5'00" |
| 3. Washing with water | 3'15" |
| 4. Stabilizing | 3'15" |

Composition of processing solutions:

Color developer

The same formulation as that used in processing (A).

Bleach-fixing solution

| | |
|---|---|
| Ferric ammonium ethylene-diaminetetraacetate | 100.0 g |
| Ferric sodium ethylene-diaminetetraacetate | 4.0 g |
| Aqueous solution of ammonium thiosulfate (70%) | 175.0 ml |
| Sodium sulfite | 4.5 g |
| Aqueous ammonia (28%) | 15 ml |
| Water to make | 1.0 liter (PH = 6.8) |

Fixing solution

The same formulation as that used in processing (A).

TABLE 1

| Sample | Processing | Relative Blue Sensitivity* | Δ SG (Degree of Reduction in Green Layer Sensitivity) | Amount of Residual Ag (μg/cm²) |
|---|---|---|---|---|
| 101 | (A) *1 | 100 | 0.05 | 5.9 |
| 102 | (A) *1 | 53 | 0.03 | 4.8 |
| 103 | (A) *1 | 110 | +0 | 3.7 |
| 104 | (A) *1 | 121 | 0.01 | 3.4 |
| 105 | (A) *1 | 111 | 0.02 | 4.2 |
| 101 | (B) *1 | 101 | 0.08 | 31.3 |
| 102 | (B) *1 | 49 | 0.04 | 5.6 |
| 103 | (B) *2 | 116 | 0.01 | 4.9 |
| 104 | (B) *2 | 124 | 0.02 | 4.1 |
| 105 | (B) *2 | 111 | 0.03 | 7.5 |

*Relative sensitivities taking blue sensitivity of Sample 101 processed according to processing (A) as 100.
*1 Comparative example
*2 Example of the present invention As is clear from Table 1, silver halide color photographic materials can be provided which show high sensitivity and excellent desilvering properties and storage stability in spite of the simple and rapid processing, by combining the yellow filter dye and the processing of the present invention.

EXAMPLE 2

Preparation of Sample 201

Sample 201 was prepared in the same manner as Sample 101, except for omitting the first and the second layers and coating the following backing layers on the opposite side of the support.

First backing layer:

A gelatin layer containing dye W-2 in an amount of $3.0\times10^{-5}$ mol/m² and dye W-3 in an amount of $4.0\times10^{-5}$ mol/m².

Second backing layer:

The same as the 12th layer of Sample 101.

Dye W-1

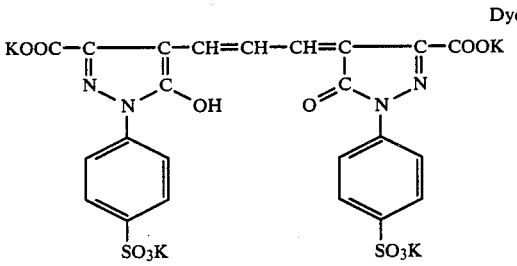

Dye W-2

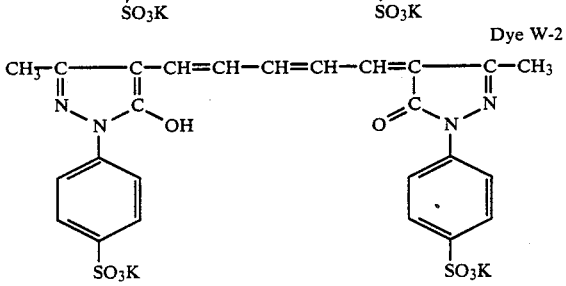

Preparation of Sample 202

Sample 202 was prepared in the same manner as Sample 201, except for using dye Y-32 in an amount of $1.0\times10^{-3}$ mol/m² in the 8th layer in place of the yellow colloidal silver and not using contact fog-preventing agent S-1. Y-32 was added to the coating solution as a dye dispersion prepared by dissolving in a mixed solvent of ethyl acetate and tricresyl phosphate under heating, dispersing the resulting solution in a gelatin aqueous solution using a colloid mill, then adding thereto an aqueous latex of ethyl acrylate to mix.

Samples 201 and 202 (three samples for each) were wedgewise exposed and subjected to processing (A), (B), or (C) to measure the amount of residual silver in maximum color density area. Results thus obtained are tabulated in Table 2.

Processing (A): The same as processing (A) in Example 1.

Processing (B): The same as processing (B) in Example 1.

Processing (C):

Development processing step (38° C.)

| | |
|---|---|
| 1. Color development | 3'15" |
| 2. Bleaching | 1'30" |
| 3. Bleach-fixing | 2'30" |
| 4. Washing with water | 3'15" |
| 5. Stabilizing | 3'15" |

Color developing solution

The same formulation as that used in processing (A).

Bleaching solution

The same formulation as that in processing (A).

Bleach-fixing solution

The same formulation as the bleach-fixing solution in processing (B).

TABLE 2

| Sample | Processing | Residual Silver Amount (μg/cm2) | Remark |
|---|---|---|---|
| 201 | (A) | 4.5 | Comparative Ex. |
| 202 | " | 3.9 | Comparative Ex. |
| 201 | (B) | 25.4 | Comparative Ex. |
| 202 | " | 6.4 | Present Invention |
| 201 | (C) | 12.8 | Comparative Ex. |
| 202 | " | 4.5 | Present Invention |

As is apparent from Table 2, the present invention enables formation of color images showing remarkably improved desilvering properties in the simplified and accelerated processings (B) and (C).

The silver halide color photographic materials of the present invention shows excellent desilvering properties in the simplified and accelerated processing using a bleach-fixing solution and can form vivid color images containing an extremely slight amount of residual silver.

The silver halide color photographic material of the present invention shows an excellent filter effect of the yellow dye layer, and, since blue light to the green and red-sensitive layers is cut in an extremely high ratio, it reproduces extremely good color. In addition, since the yellow dye does not diffuse from the layer to which it has been added to other layers, the dye does not exert detrimental influences on photographic properties. Further, since the yellow dye to be used in the present invention is decolored during photographic processing, it does not give a remaining color or stain after processing. Usually, reduction in diffusibility of dye is accompanied by the problem of deterioration of decoloring properties. However, the yellow dyes to be used in the present invention do not cause such problem.

In addition, even when an emulsion comprising tabular grains is used in a layer adjacent to the yellow filter layer, desilvering properties are not deteriorated.

While the present invention has been described in detail and with reference to specific embodiments thereof, it is apparent to those skilled in the art that various changes and modifications can be made therein without departing from the spirit and the scope of the present invention.

What is claimed is:

1. A color image-forming process for a silver halide color photographic material comprising a support having provided thereon at least one red-sensitive silver halide emulsion layer, at least one green-sensitive silver halide emulsion layer, and at least one blue-sensitive silver halide emulsion layer, which process comprises dispersing in a light-insensitive hydrophilic colloid layer provided at a position nearer to the support than a blue-sensitive layer and more distant from the support than a green-sensitive layer and a red-sensitive layer in the photographic material a yellow dye represented by formula (I) and processing the photographic material using a bleach-fixing solution containing a ferric complex of aminopolycarboxylic acid and a thiosulfate, said formula (I) being represented by

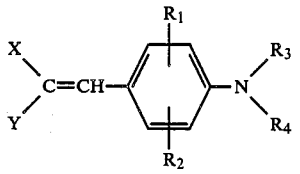

(I)

wherein $R_1$ and $R_2$ each represents a hydrogen atom, a halogen atom, an alkyl group, an alkoxy group, a hydroxy group, a carboxy group, a substituted amino group, a carbamoyl group, a sulfamoyl group, a nitro group, or an alkoxycarbonyl group, $R_3$ and $R_4$ each represents a hydrogen atom, an unsubstituted or substituted alkyl group, an unsubstituted or substituted alkenyl group, an unsubstituted or substituted aryl group, an acyl group or a sulfonyl group, or $R_3$ and $R_4$ may be taken together to form a 5- or 6-membered ring, X represents a cyano group, and Y represents an acyl group or a sulfonyl group.

2. A color image-forming process for a color photographic material as in claim 1, wherein said dye represented by formula (I) is present in an amount of from 1 to 2,000 mg/m$^2$ of the light-sensitive material.

3. A color image-forming process for a color photographic material as in claim 1, wherein said dye represented by formula (I) is present in an amount of from 50 to 800 mg/m$^2$ of the light-sensitive material.

4. A color image-forming process for a color photographic material as in claim 1, wherein said ferric complex of aminopolycarboxylic acid is used in an amount of from 50 to 300 g/liter.

5. A color image-forming process for a silver halide color photographic material as in claim 1, wherein said silver halide emulsion layers primarily contain silver iodobromide or silver iodochlorobromide.

6. A color image-forming process for a color photographic material as in claim 1, wherein an optical density of said color photographic material ranges of from 0.05 to 3.0.

7. A color image-forming process for a color photographic material as in claim 1, wherein said yellow dye represented by formula (I) is incorporated in yellow filter layer.

8. A color image-forming process for a color photographic material as in claim 7, wherein an emulsion layer adjacent to said yellow filter layer contains tabular grains having a diameter-to-thickness ratio of 5 or more.

* * * * *